US005975280A

United States Patent [19]

Cote et al.

[11] Patent Number: 5,975,280

[45] Date of Patent: Nov. 2, 1999

[54] DEVICE FOR TRANSPORTING FLAT PRODUCTS TO FURTHER PROCESSING UNITS OR DELIVERY STATIONS

[75] Inventors: Kevin L. Cote, Durham; Richard D. Curley, Dover; Charles H. Dufour, Durham, all of N.H.

[73] Assignees: Heidelberger Druckmaschinen; Heidelberger Harris, Inc., both of Heidelberger, Germany

[21] Appl. No.: 08/709,796

[22] Filed: Sep. 9, 1996

[51] Int. Cl.[6] ..... B65G 29/00

[52] U.S. Cl. ..... 198/474.1; 198/465.2; 198/795; 198/459.4

[58] Field of Search ..... 198/459.3, 459.21, 198/465.1, 465.2, 465.3, 474.1, 795, 803.4

[56] References Cited

U.S. PATENT DOCUMENTS

| | | | |
|---|---|---|---|
| 2,789,683 | 4/1957 | Stahl | 198/795 X |
| 3,858,519 | 1/1975 | Masino et al. | 198/795 X |
| 3,972,413 | 8/1976 | Simeth . | |
| 3,991,685 | 11/1976 | Toby | 198/465.2 X |
| 4,007,824 | 2/1977 | Reist . | |
| 4,072,228 | 2/1978 | Honegger et al. . | |
| 4,168,775 | 9/1979 | Mueller | 198/795 |
| 4,359,149 | 11/1982 | Erlichman et al. | 198/465.2 X |
| 4,550,822 | 11/1985 | Meier . | |
| 4,757,893 | 7/1988 | Shabram, Jr. et al. | 198/474.1 |
| 4,887,809 | 12/1989 | Eberle . | |
| 5,161,664 | 11/1992 | LeBras | 198/465.2 X |
| 5,280,830 | 1/1994 | Schiaretti et al. | 198/795 X |
| 5,503,264 | 4/1996 | Eberle . | |
| 5,718,323 | 2/1998 | Flix | 198/474.1 X |

FOREIGN PATENT DOCUMENTS

| | | |
|---|---|---|
| 1 153 383 | 8/1963 | Germany . |
| 1 193 065 | 1/1966 | Germany . |

*Primary Examiner*—James R. Bidwell
*Attorney, Agent, or Firm*—Kenyon & Kenyon

[57] ABSTRACT

A device for transporting flat products to further processing units is provided which includes a track 4 forming a continuous loop, a plurality of gripper elements 1 and a driving module 99. The gripper elements 1 are arranged on the track 4, and include a gripper 2 for seizing a flat product 11 from a first device and releasing the flat product to a second device 13. Each gripper element 1 moves independently from each other gripper element 1 along at least a portion of the track 4. Each gripper element is selectively engaged by the driving module 99 for movement along the track. The driving module 99 may include, for example, a drive unit 9 for driving the gripper elements in a side-by-side configuration without pitch; an extended pitch driving unit 7 for driving the gripper elements at a defined pitch; an acceleration unit 6 for accelerating the gripper elements to the defined pitch; and/or a diverting unit 32 for diverting selected gripper elements to an alternate track.

16 Claims, 8 Drawing Sheets

DEVICE FOR TRANSPORTING FLAT PRODUCTS TO FURTHER PROCESSING UNITS OR DELIVERY STATIONS

FIELD OF THE INVENTION

The present invention relates to a device for transporting flat products to further processing units or delivery stations such as post press equipment arranged behind a folding apparatus or a rotary printing machine.

BACKGROUND OF THE INVENTION

U.S. Pat. No. 3,972,413 purports to disclose a chain conveyor for printing presses. A pair of spaced-apart roller chains guided for movement about an endless path have straight and curved portions. On the chains, gripper frames are mounted, each including first and second cross bars with conveying grippers and corresponding gripper pads mounted thereon.

U.S. Pat. No. 4,550,822 purports to disclose an apparatus for transporting flat products, especially products arriving in an imbricated formation. Along a conveying path a chain having single gripper elements assigned thereto is moved. A cam assigned to the conveying path moves a lever prior to seizing of products in a downward position. After the gripping elements have passed the cam, the lever is released, thus swinging in a vertical position, gripping a single product being transported in a shingled formation.

U.S. Pat. No. 4,072,228 purports to show an apparatus for evening an imbricated stream of printed products. A number of revolving entrainment members are in a drag connection with one another. At the region of their conveying-active path, the entrainment members are guided and at the start of their path driven by a thrust drive and at the end of their path driven by a traction drive. The entrainment members engage the printed products and the thrust and traction drives cause a change in the spacing of the entrainment members and, consequently, in the spacing of the products having an shingled formation.

DE 11 93 065 purports to show a conveying system having a closed loop conveying track at the end of which a chain like driving unit is arranged. At the maximum elevation conveying elements move downwards subject to gravity along an inclined track section. Flat rectangular plates are fastened to the conveying elements allowing for separation of stacks of a number of flat products being conveyed in a substantially vertical direction. The orientation of the flat products changes from an imbricated formation in a horizontal position into a vertical position, where the single flat products are parallel to one another.

SUMMARY OF THE INVENTION

In accordance with the present invention, a device for transporting flat products to further processing units is provided which includes a track forming a continuous loop, a plurality of gripper elements and a driving module. The gripper elements are arranged on the track, and include a gripper for seizing a flat product from a first device and releasing the flat product to a second device. Each gripper element moves independently from each other gripper element along at least a portion of the track. Each gripper element is selectively engaged by the driving module for movement along the track. The driving module may include, for example, a drive unit for driving the gripper elements in a side-by-side configuration that is regarded as being without pitch, meaning that the gripper elements are in contact with each other. The driving module further includes an extended pitch driving unit for driving the gripper elements at a defined pitch, an acceleration unit for accelerating the gripper elements to the defined pitch, and/or a diverting unit for diverting selected gripper elements to an alternate track.

In accordance with a first embodiment of the present invention, the extended pitch driving unit is arranged along the track and the gripper elements can be selectively engaged by the extended pitch driving unit for movement along the track at a fixed pitch. In accordance with a further embodiment of the present invention, the extended pitch driving unit includes a pitched train drive, and the pitched train drive includes a plurality of drive elements spaced apart at a defined pitch on a rotating chain.

In accordance with a second embodiment of the present invention, the drive unit, which drives the gripper elements in a side-by-side configuration without pitch, may be constructed as a chain drive.

In accordance with a third embodiment of the present invention, the acceleration unit is arranged along the track upstream of the extended pitch driving unit. Gripper elements are selectively engaged by the acceleration unit and accelerated for receipt by the extended pitch driving unit. The acceleration unit may include a plurality of arms rotating about a central axis. A seizing element is arranged on each of the plurality of arms for seizing and releasing the gripper elements. The acceleration unit may further include a cam operated indexing box for rotating the arms, and the seizing elements may further include magnetic couplers for seizing and releasing the gripper elements. A slip ring mechanism may coupled to each magnetic coupler for actuating the magnetic coupler to seize and release the gripper elements.

In accordance with a fourth embodiment of the present invention, the diverting unit is arranged along the track and an alternate track. The diverting unit selectively seizes certain gripper elements from the track, and delivers them to the alternate track. The diverting unit may be of the same construction as the acceleration unit. A drive unit may be arranged on the alternate track downstream of the diverting unit to transport the gripper elements along the alternate track in a side-by-side configuration without pitch. Alternatively, an extended pitch driving unit may be arranged on the alternate track to transport the gripper elements along the alternate track at a defined pitch.

Naturally, the acceleration unit, the diverting unit, the drive unit, and the extended pitch driving unit may be arranged along the track (or alternate track) in a variety positions in order to accommodate a variety of processing applications. Since the gripper elements can be driven independently from one another, the present invention allows great flexibility in processing of the flat products.

For example, since the gripper elements move independently along the track, they can be transported at a large pitch while empty, and at a smaller pitch while transporting the flat products. This, in turn, reduces the number of gripper elements needed to transport the flat products.

In addition, in accordance with the present invention, the gripper elements can easily be driven at different pitches along different portions of the track while transporting flat products. In a given application, signatures exiting, for example, a folding device, may need to be transported to several different delivery stations. These delivery stations may having varying input capabilities.

For example, if the delivery station is a further conveying system, it may need a greater pitch between signatures than, for example, a stacker. In accordance with an embodiment of the present invention, the pitch between gripper elements can be easily altered to accommodate delivery stations with differing pitch requirements.

Similarly, one delivery station may be capable of accepting more signatures per second than another. In accordance with an embodiment of the present invention, by transferring the gripper elements traveling at a given pitch to a relatively slow moving drive unit which drives the gripper elements with no pitch, the signatures being transported by the gripper elements are slowed down for receipt by a slow speed delivery station.

In addition, in certain applications it may be desirable to transport the gripper elements at a high speed while seizing the signatures from, for example, a high speed folding device, to transport them at relatively slow speeds en route to a delivery station, and then to transport them at relatively high speeds while releasing the signatures to the delivery station. In accordance with an embodiment of the present invention, the gripper elements could be accelerated to a high speed by a first acceleration unit, and then transported at high speed under the control of a first extended pitch driving module to seize the signatures from the high speed folding device. The gripper elements could then be slowed down by a relatively slow moving drive unit which could transport the gripper elements in a side-by- side configuration towards the high speed delivery station. Upon approaching the high speed delivery station, the gripper elements could be accelerated to a high speed by a second acceleration unit, and then transported at high speed under the control of a second extended pitch driving module to deliver the signatures to the high speed delivery station.

DETAILED DESCRIPTION OF THE INVENTION

Figure 1:
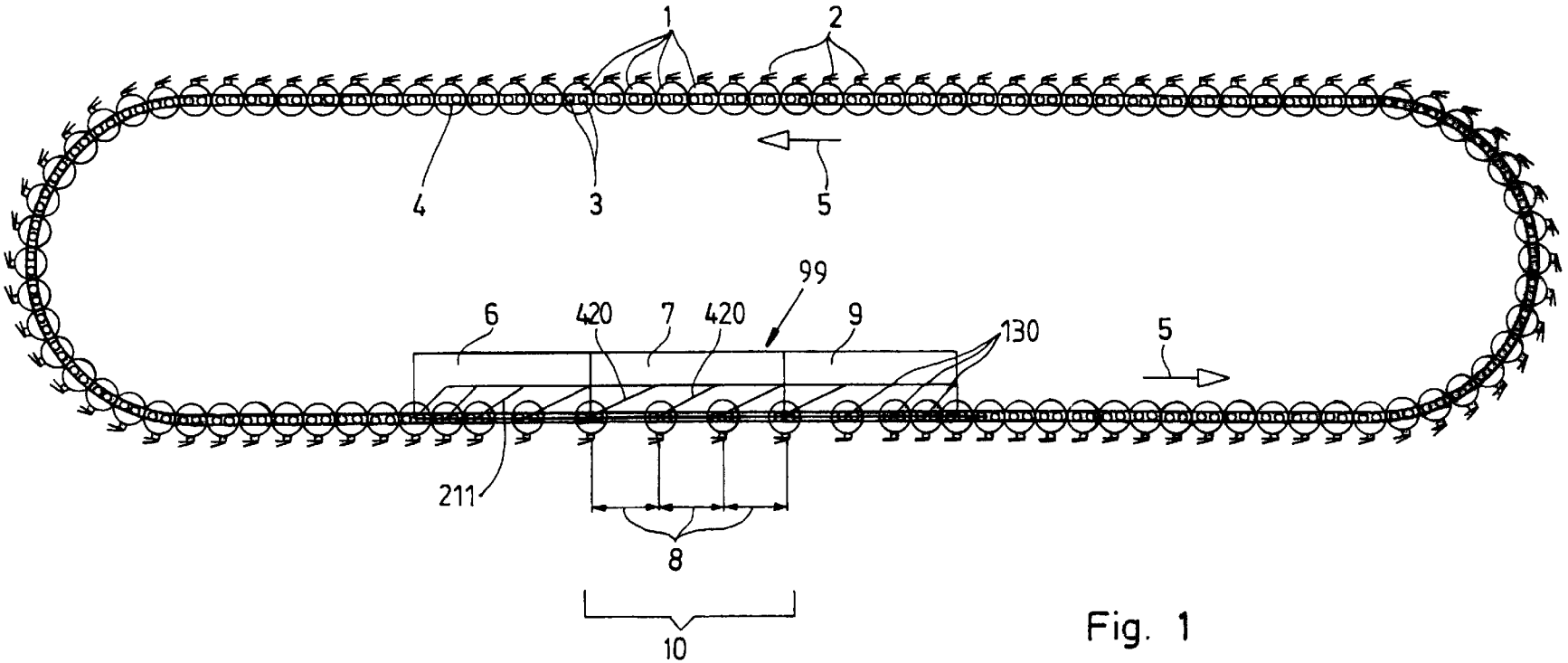
FIG. 1 shows a conveying track for gripper elements having an acceleration unit, an extended pitch driving unit, and a drive unit according to the present invention.

FIG. 1 shows a conveying track 4 for transporting gripper elements 1, and having a driving module 99 including an accelerating unit 6, an extended pitch driving unit 7, and a deceleration unit 9.

A plurality of gripper elements 1 are mounted on the conveying track 4. Each gripper element 1 includes receptacles 3, such as bushings, which are engageable with the driving module 99. The gripper elements 1 are independently mounted on the track 4 so that they can move independently from one another along the track in a conveying direction 5. Each gripper element 1 includes a gripper 2 for seizing flat products such as signatures.

Figure 2:
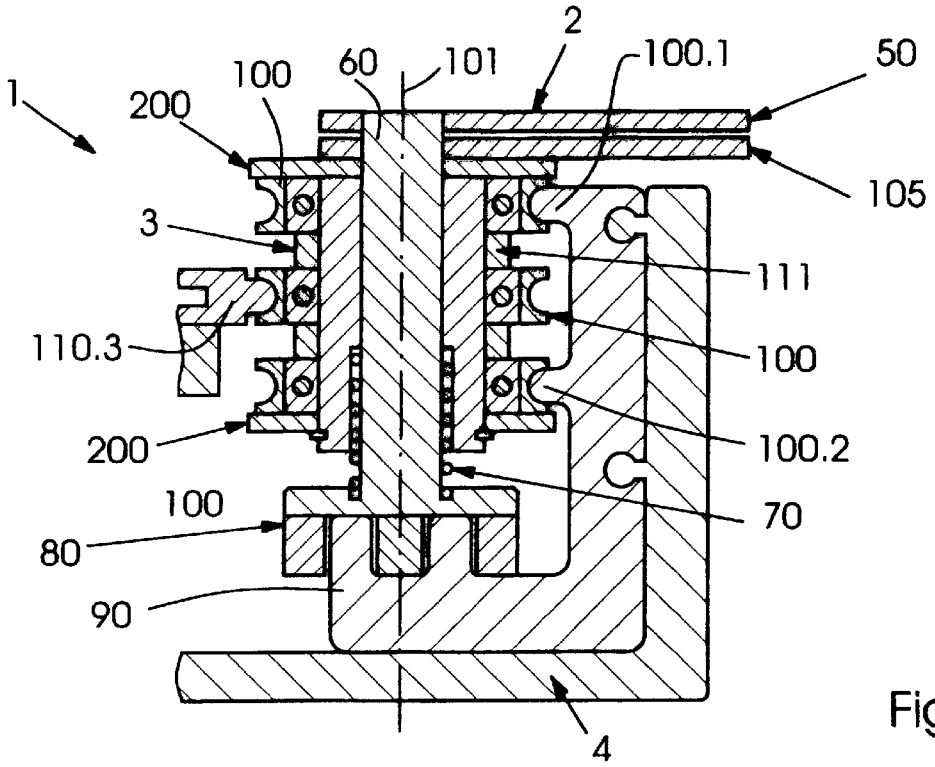
FIG. 2 shows a cross-section of a gripper element mounted on the conveying track according to the present invention.
Figure 3:
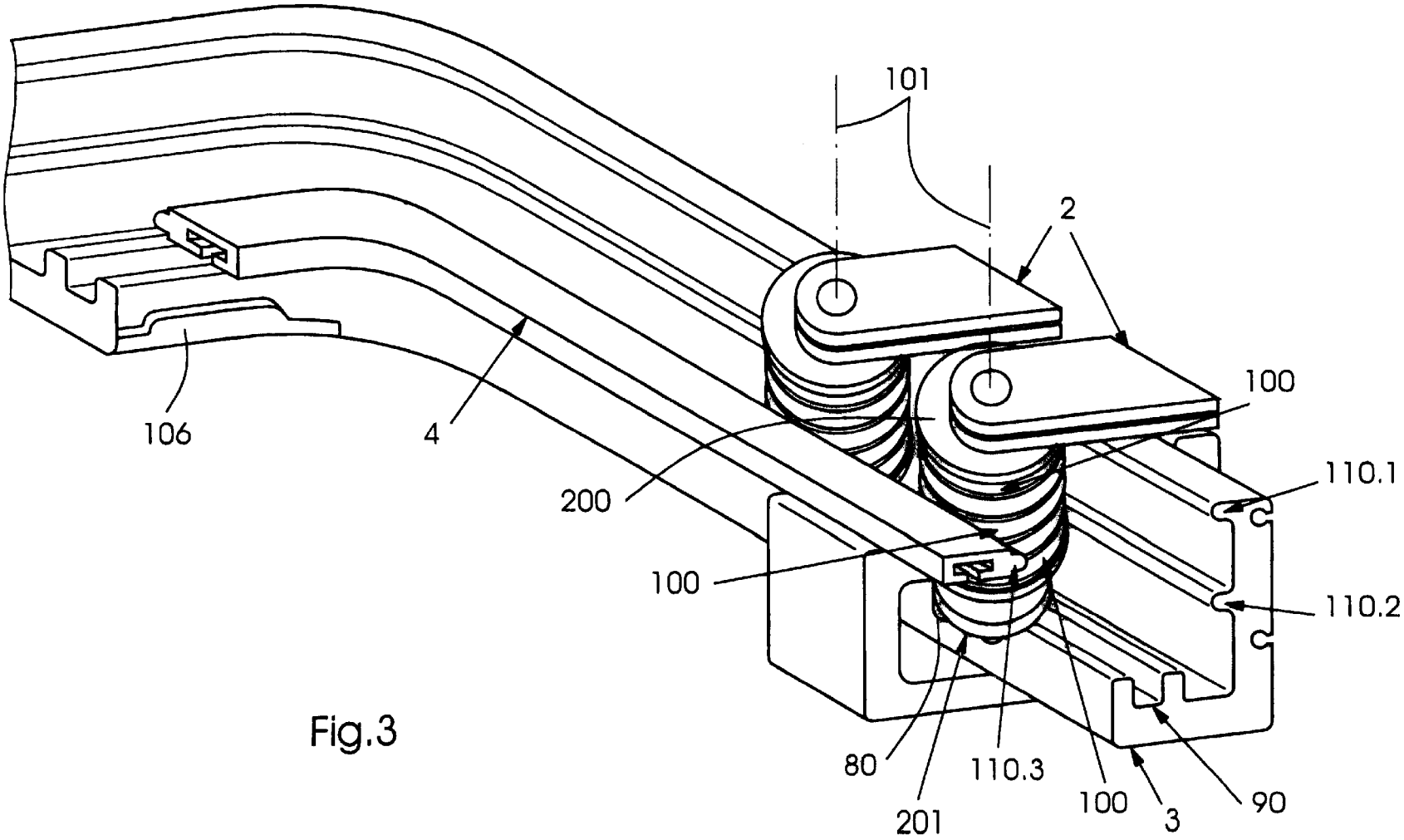
FIG. 3 shows a side view of the gripper element mounted on the conveying track according to the present invention.

Referring to FIGS. 2, 3, the gripper element 1 includes three independent wheels 100 which are stacked one above the other along a common axis 101. The wheels 100 ride on respective rails 110.1, 110.2, 110.3 of the track 4. A pair of discs 200 extend radially beyond the wheels 100, and serve as bumpers which allow the wheels 100 to rotate freely even when two gripper elements 1 are directly adjacent to one another as shown in FIG. 3.

The gripper 2 includes an upper jaw 50 and a lower jaw 105 which separate to release a flat product and close to grip a flat product. The upper jaw 50 is attached to a plunger rod 60. The plunger rod 60 is spring loaded via a spring 70. The plunger rod 60 has five tabs 80 which ride on a lower channel 90 of the track 4. The lower jaw 105 is connected to a sleeve 111 which is keyed or splined to the plunger rod 60. The gripper 2 can therefore be opened by applying an upward force to one of the tabs 80 by, for example, placing a raised surface 106 at a desired point in the path of the tab 80 as shown in FIG. 3.

Figure 4B:
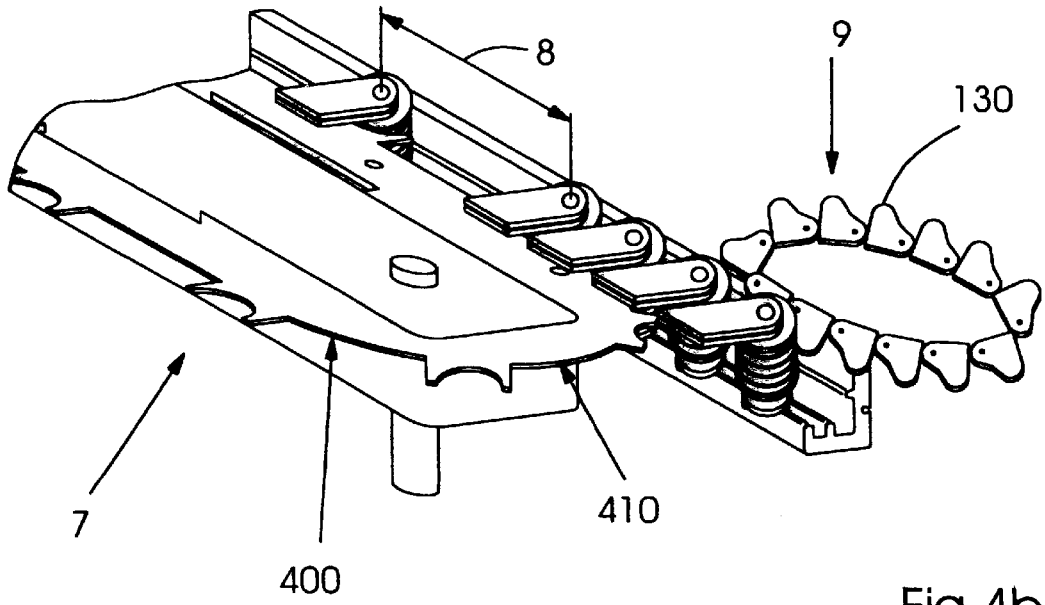
FIGS. 4(*a,b*) show a pair of drive units, an acceleration unit, and an extended pitch driving unit according to the present invention.
Figure 4A:
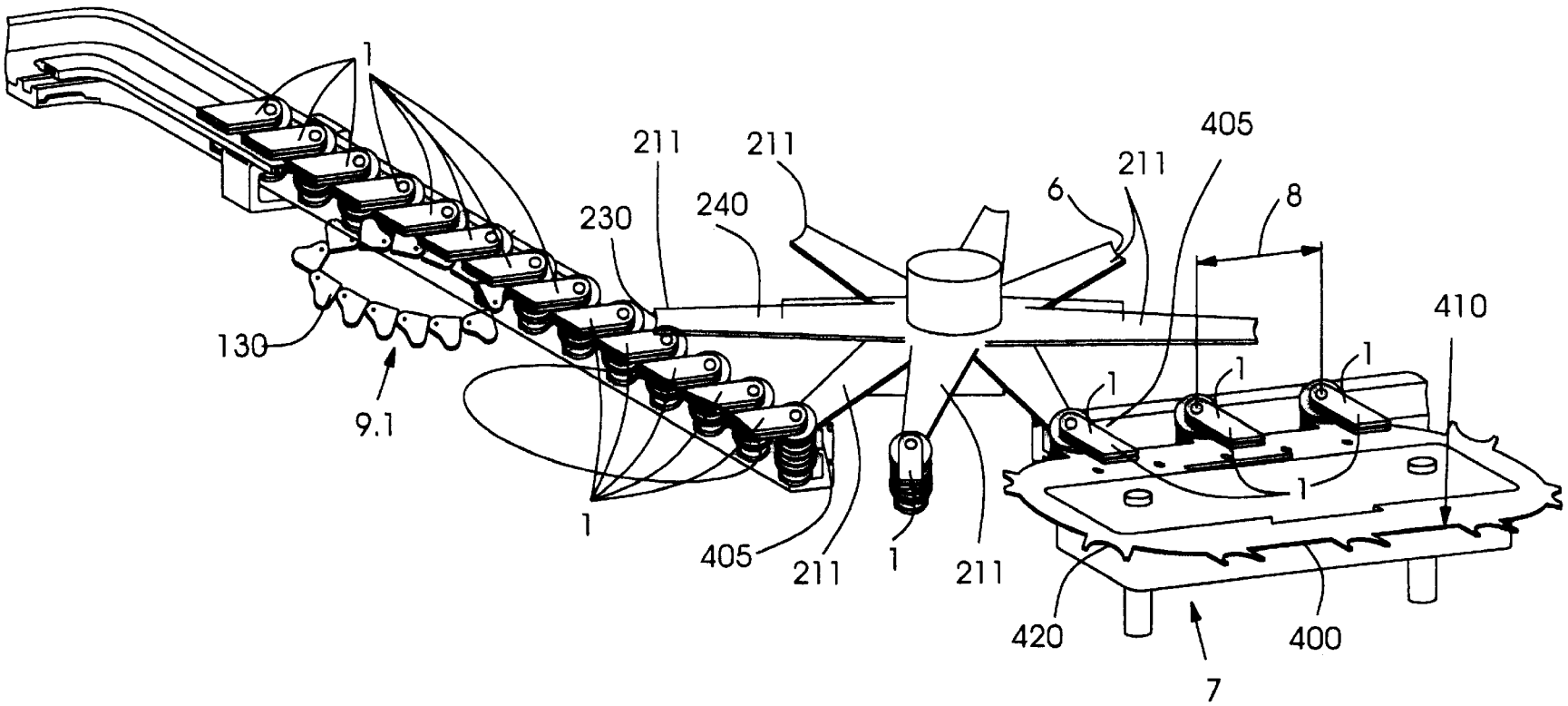

FIG. 4*a* shows the extended pitch driving unit 7, which individually engages each of the gripper elements 1 and establishes a temporarily pitch 8 between the gripper elements 1 for a predetermined length 10, which is illustrated in FIG. 1. Prior to the extended pitch driving unit 7, an acceleration unit 6 is arranged for accelerating the gripper elements 1 before they are engaged by the extended pitch driving unit 7. Referring to FIG. 4*a*, the accelerating unit 6 may include a plurality of rotating arms 211 having seizing elements arranged thereon. The rotating arms 211 are driven by a cam operated indexing box; e.g. a Ferguson drive. The seizing elements may, for example, be magnetic couplers 230 actuated by a slip-ring mechanism 240. The rotating arms 211 grip the gripper elements 1, accelerate them, and then deliver them to the extended pitch driving module 7. An opening 405 is provided in the track 4 between rails 110.1 and 110.2 to allow the rotating arms 211 to engage the receptacles 3 on the gripper element I (shown in FIG. 2). The extended pitch driving unit 7 includes a pitched chain drive 400. The pitched chain drive 400 includes drive elements 420 mounted on a rotating chain 410 which engage the recepticals 3. The drive elements 420 are spaced apart at the pitch 8.

After the extended pitch driving unit 7, a drive unit 9 may be provided for narrowing the pitch 8 between the gripper elements 1. As shown in FIG. 4*b*, the drive unit 9 may be configured as a drive chain 130 located downstream of the extended pitch driving unit 7. The drive chain 130 rotates at a slower speed than the pitched chain drive 400. Therefore, the gripper elements 1 will contact one another as the drive unit 9 pushes the gripper elements 1 along the track 4 in the conveying direction 5. Since the gripper elements 1 are in contact with each other as they exit the drive unit 9, no driving mechanism is required between the drive unit 9 and the acceleration unit 6. However, as shown in FIG. 4*a*, a drive unit 9.1 may also be provided prior to the acceleration unit 6.

By conveying the gripper elements at the pitch 8, processing of flat products, e.g. signatures, can be facilitated. For example, it may be advantageous to seize signatures from an upstream processing device (e.g. a folder, or a conveyor) while the gripper elements are separated by the pitch 8 in order to allow enough space and time to accurately seize the signature. Once the signatures are seized by respective gripper elements 2, however, it may be advantageous to convey them to further post press equipment (e.g, a stacker) in a closer formation.

Figure 5:
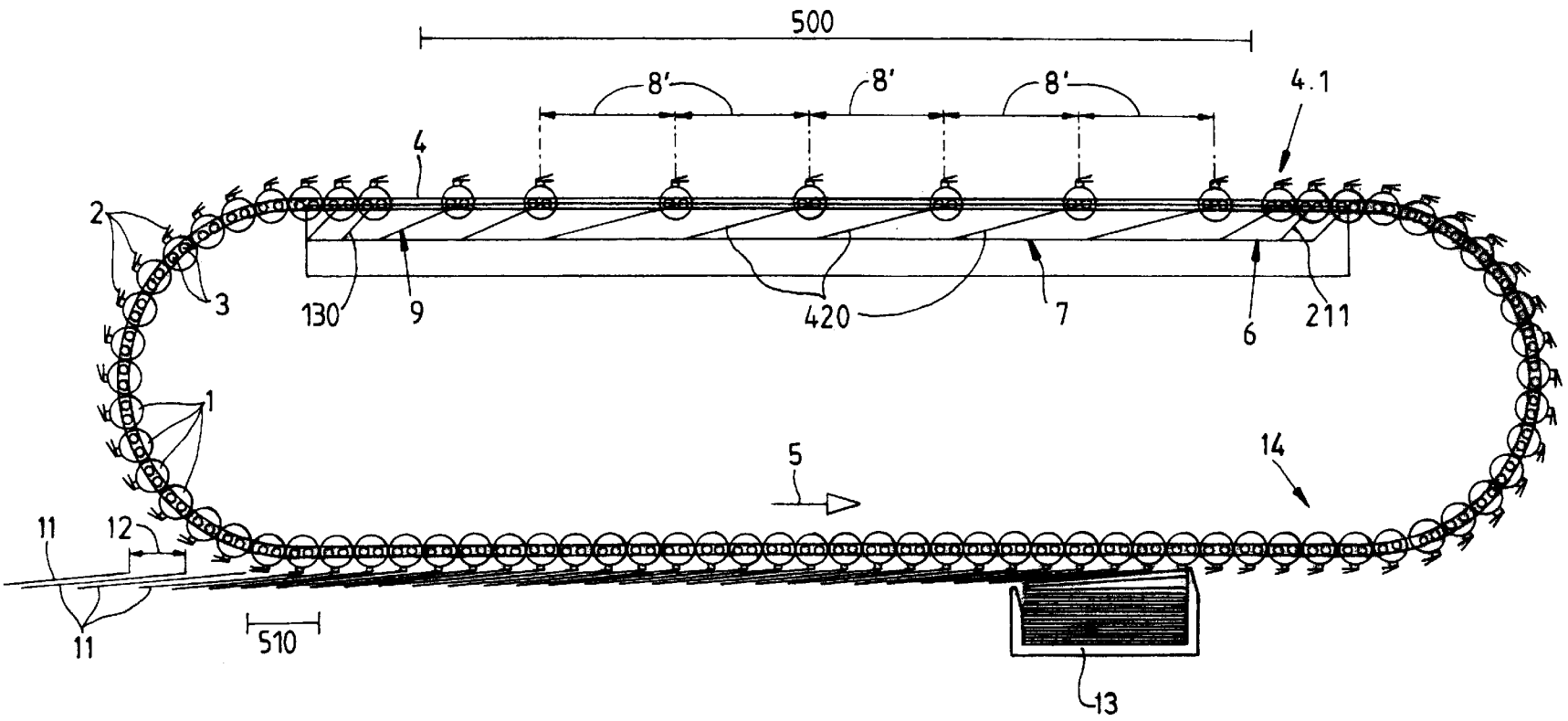
FIG. 5 shows an alternative conveying track according to the present invention including a delivery station.

FIG. 5 shows a second embodiment of the present invention, with similar components bearing the same reference numerals as FIGS. 1 through 4. Signatures 11 are conveyed in an imbricated formation, and delivered to a post press equipment 13, such as a stacking unit or the like.

In this configuration, an extended pitch driving unit 7, a drive unit 9, and a acceleration unit 6 are assigned to an upper portion of the track 4 along which the gripper elements 1 move independently from one another in the manner described above with regard to FIGS. 1–4. As the gripper elements 1 move under the control of the extended pitch driving unit 7, they have a defined pitch 8'. Upon reaching the drive unit 9, the gripper elements are decelerated and the pitch 8' is removed. The gripper elements 1 then move along the conveying track 4, seizing signatures 11 which are being conveyed at a pitch 12 by an upstream processing device (not shown). The signatures 11 are seized by the grippers 2 of the gripper elements 1 and conveyed to the post press equipment 13. After delivering the signatures 11 to the post press equipment 13, the empty gripper elements move in conveying direction 5 along the conveying track 4. In accordance with this embodiment, by employing the acceleration unit 6 and the extended pitch driving unit 7 in a non-signature transporting area 500, the number of gripper elements 1 needed to transport signatures can be reduced.

Figure 6:
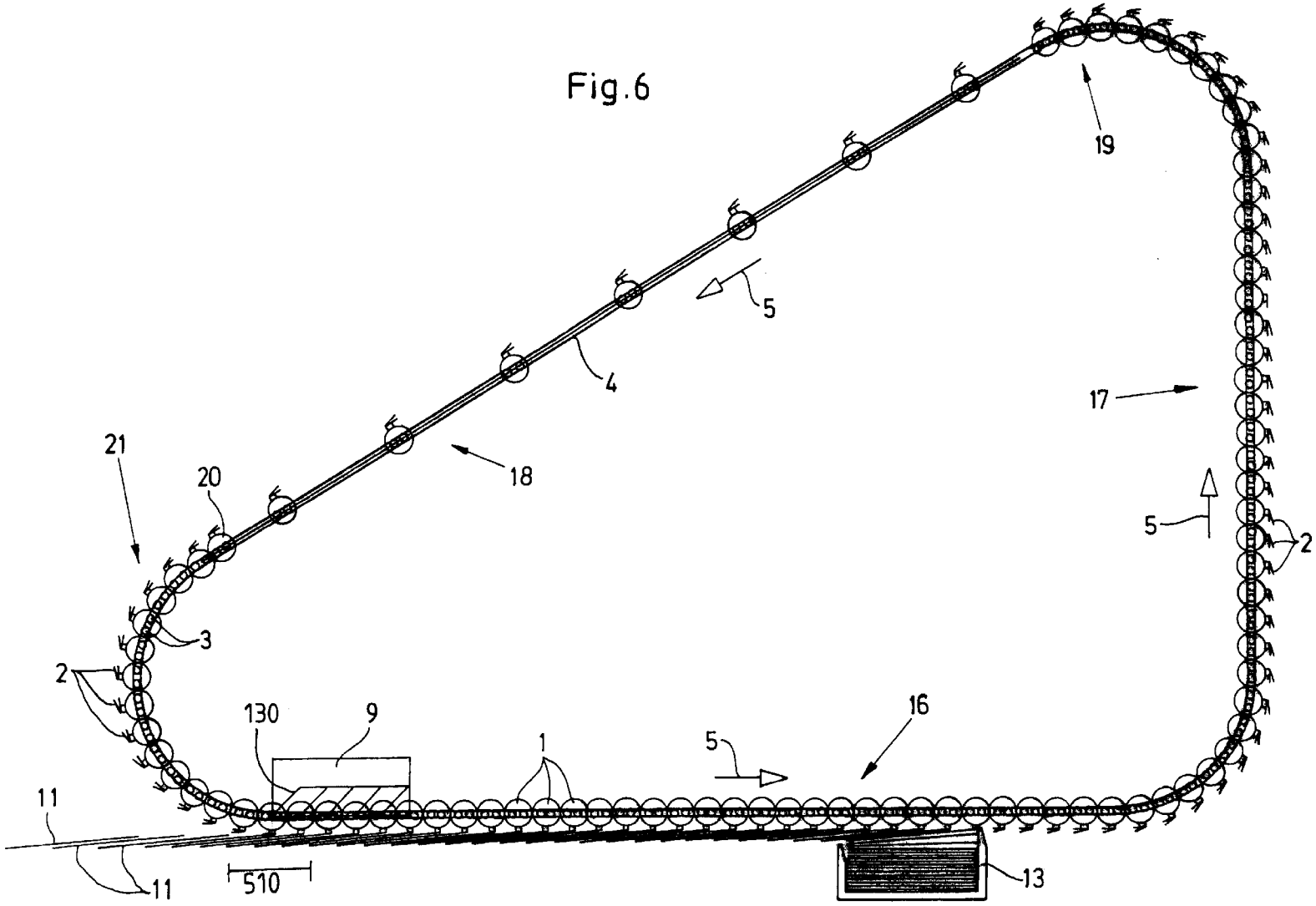
FIG. 6 shows an alternative conveying track according to the present invention having a horizontal track section, a vertical track section, and an inclined track section.

FIG. 6 shows a conveying track in accordance with a third embodiment of the present invention, with similar components bearing the same reference numerals as FIGS. 1 through 5.

The conveying track 4 includes a horizontal track section 16, a vertical track section 17, and an inclined track section 18. A drive unit 9 is mounted along a portion of the horizontal track section 16 to drive the gripper elements 1 in the conveying direction 5. The drive unit 9 moves the gripper elements along the horizontal track section 16, and through the vertical track section 17 to a maximum elevation 19. From the maximum elevation 19 the gripper elements 1 separate and move along the inclined track section 18 under the force of gravity until they contact a last gripper element 20 of a queue 21. Since the drive unit 9 is mounted along the horizontally extending track section 16, the gripper elements 1 in the queue 21 are subsequently moved along the horizontal and vertical track sections 16, 17. The gripper elements 1 seize signatures 11 in a product seizing area 510, convey the signatures along the horizontal track section 16 in an imbricated formation, and releases the signatures 11 to post press equipment 13.

Figure 7:
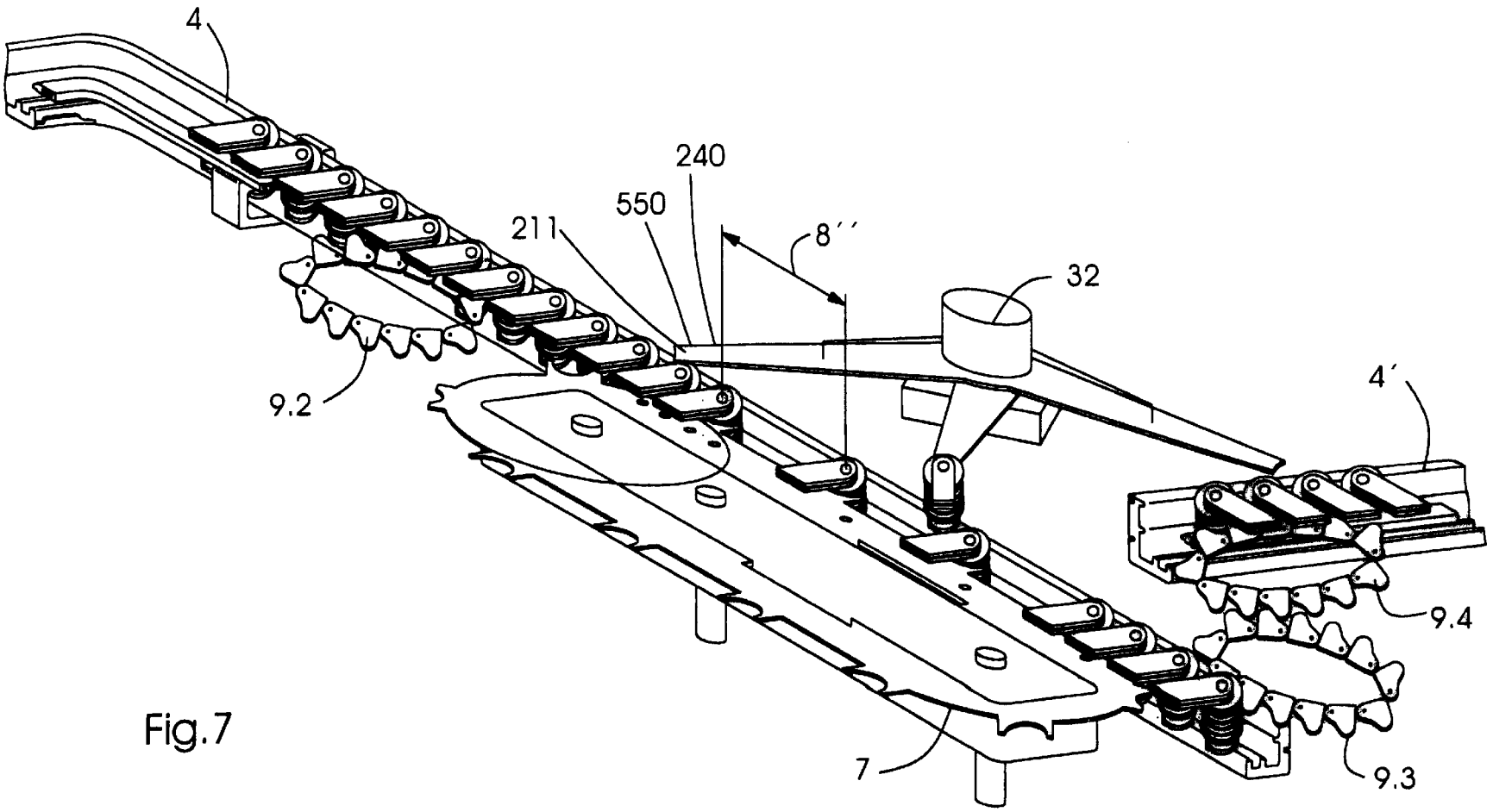
FIG. 7 shows a diverting unit according to the present invention.

FIG. 7 shows a portion of a conveying track 4 in accordance with a fourth embodiment of the present invention. The conveying track 4 includes a drive unit 9.2, an extended pitch driving unit 7, a diverting unit 32, a drive unit 9.3, and a drive unit 9.4. The gripper elements 1 are conveyed along the track 4 in a side-by-side configuration with no pitch under the control of the drive unit 9.2 until they reach a diverting area 550. At the diverting area 550 every other gripper element 1 is seized by an arm 211 of the diverting unit 32. Each gripper element 1 which is not seized by the diverting unit 32 is instead seized by the extended pitch driving unit 7. The diverting unit 32, which may be constructed in the same manner as the acceleration unit 6, transports the seized gripper elements to an alternate track 4'. Once the gripper elements 1 are received in the alternate track 4', they are slowed down by the drive unit 9.4 and transported in a side-by-side configuration with no pitch as shown. The gripper elements 1 which were seized by the extended pitch driving unit 7 are conveyed with a pitch 8" until they reach the drive unit 9.4, where they are slowed down and transported along the track 4 in a side-by-side configuration with no pitch.

Figure 8:
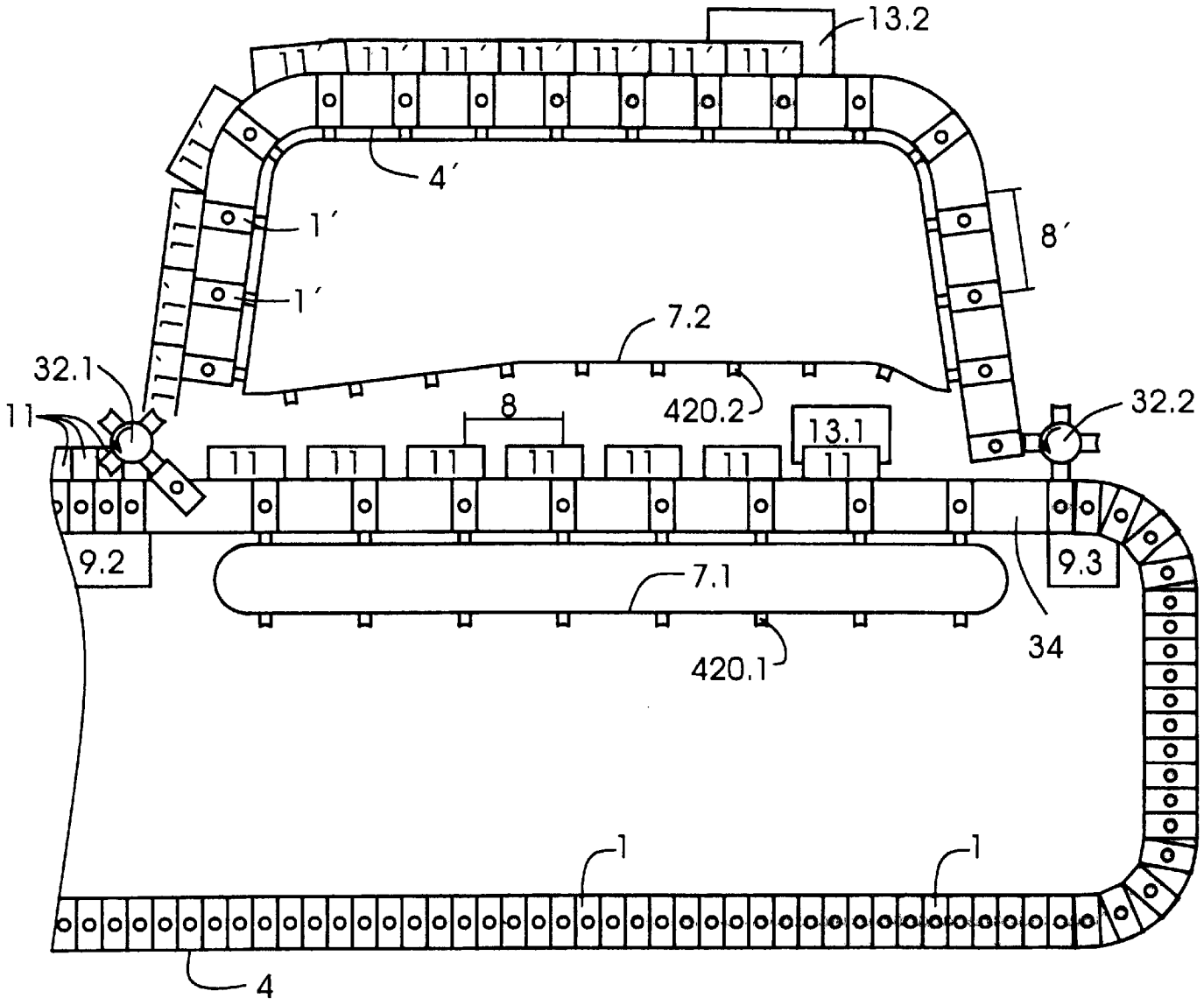
FIG. 8 shows an alternative conveying track according to the present invention including a diverting unit.

FIG. 8 shows a further embodiment according to the present invention, which includes a track 4 and an alternate track 4'. Gripper elements 1, 1' are transported along track 4 in a side-by-side configuration with no pitch under the control of the drive unit 9.2. Every second gripper element 1' is seized by the diverting unit 32.1 and transported to the alternate track 4'.

Each gripper element 1 which is not seized by the diverting unit 32.1 continues along the track 4, is seized by the extended pitch driving unit 7.1, and transported by the extended pitch driving unit 7.1 at a pitch 8. The gripper elements 1 then release their respective signatures 1 into post press equipment 13.1.

The gripper elements 1' which are diverted to the alternate track 4' are seized by the extended pitch driving unit 7.2, and transported along the track 4' at a pitch 8'. The gripper elements 1' then release their respective signatures 11' into post press equipment 13.2.

The empty gripper elements 1' continue to travel along the track 4' until they are seized by the diverting unit 32.2, and are merged within a merging area 34 with the empty gripper elements 1. Upon exiting the merging area 34, the gripper elements 1, 1' are engaged by the drive unit 9.3 and conveyed along the track 4 in a side-by-side configuration with no pitch.

It should be noted that the extended pitch driving units 7 can be constructed to allow the pitch 8 to be set to any desired value by utilizing seizing elements 420 which are removable. Similarly, the speed of the drive unit 9, the acceleration unit 6, and the diverting unit 32 can be adjusted to provide proper timing for exchanging and transporting the signatures 11.

What is claimed is:

1. A device for transporting flat products to further processing units, comprising:

a track forming a continuous loop;

a plurality of gripper elements arranged on the track, each gripper element including a gripper for seizing a flat product from a first device and releasing the flat product to a second device, each gripper element moving independently from each other gripper element along at least a portion of the tracks; and a driving module assigned to the track, the driving module including:

an extended pitch driving unit arranged along the track, each gripper element being selectively engaged by the extended pitch driving unit for movement along the track at a fixed pitch; and an acceleration unit arranged along the track upstream of the extended pitch driving unit, each gripper element being selectively engaged by the acceleration unit and accelerated for receipt by the extended pitch driving unit.

2. The device according to claim 1, wherein each gripper element includes a receptacle and is selectably engaged by the driving module at the receptacle.

3. The device according to claim 2, wherein the receptacle is a bushing.

4. The device according to claim 1, wherein the driving module further includes a drive unit located downstream of the extended pitch driving unit, the drive unit decelerating the gripper elements as the gripper elements exit the extended pitch driving unit and then driving the gripper elements along the track in a side-by-side configuration without pitch.

5. The device according to claim 1, further comprising: an alternate track;

and wherein the driving module further includes a diverting unit, the diverting unit selectively seizing certain gripper elements from the track, and delivering the certain gripper elements to the alternate track.

6. The device according to claim 5, wherein the diverting unit includes a plurality of arms rotating about a central axis, a respective seizing element mounted on each of the plurality of arms for seizing the certain gripper elements.

7. The device according to claim 6, wherein the diverting unit further includes a cam operated indexing box for rotating the plurality of arms, and wherein each seizing element includes a magnetic coupler.

8. The device according to claim 7, wherein the diverting unit further includes a slip ring mechanism coupled to each magnetic coupler for actuating the magnetic coupler to seize and release the certain gripper elements.

9. The device according to claim 5, wherein the driving module further includes a drive unit arranged along the track upstream of the diverting unit, the drive unit driving the gripper elements in a side-by-side configuration without pitch.

10. The device according to claim 5, further including a drive unit arranged along the alternate track downstream of the diverting unit, the drive unit driving the gripper elements in a side-by-side configuration without pitch.

11. The device according to claim 5, wherein the driving module further includes a drive unit arranged along the track downstream of the diverting unit the drive unit driving the gripper elements in a side-by-side configuration without pitch.

12. The device according to claim 1, wherein the acceleration unit includes a plurality of arms rotating about a central axis and a respective seizing element mounted on each of the plurality of arms for seizing the gripper elements.

13. The device according to claim 12, wherein the acceleration unit further includes a cam operated indexing box for rotating the plurality of arms, and wherein each seizing element includes a magnetic coupler.

14. The device according to claim 13, wherein the acceleration unit further includes a slip ring mechanism coupled to each magnetic coupler for actuating the magnetic coupler to seize and release the gripper elements.

15. The device according to claim 1, wherein the extended pitch driving unit includes a pitched chain drive, the pitched chain drive including a plurality of drive elements spaced apart at a defined pitch on a rotating chain.

16. The device according to claim 1, wherein the track includes a vertical track section, a horizontal track section, and an inclined track section, the driving module selectively engaging the gripper elements along a portion of the horizontal track section and driving the gripper elements along the horizontal and vertical track sections, the gripper elements being moved along the inclined track section under a gravitational force.

* * * * *